US010411347B2

(12) United States Patent
Liao et al.

(10) Patent No.: US 10,411,347 B2
(45) Date of Patent: Sep. 10, 2019

(54) PHASE SHIFTER AND ANTENNA

(71) Applicant: HUAWEI TECHNOLOGIES CO., LTD., Shenzhen (CN)

(72) Inventors: Zhiqiang Liao, Shenzhen (CN); Qiyi Lu, Shenzhen (CN); Xinneng Luo, Dongguan (CN); Junfeng Lu, Xi'an (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 64 days.

(21) Appl. No.: 15/854,224

(22) Filed: Dec. 26, 2017

(65) Prior Publication Data

US 2018/0123240 A1 May 3, 2018

Related U.S. Application Data

(63) Continuation of application No. PCT/CN2015/082051, filed on Jun. 23, 2015.

(51) Int. Cl.

| | |
|---|---|
| ***H01Q 3/32*** | (2006.01) |
| ***H01P 1/18*** | (2006.01) |
| ***H01P 1/20*** | (2006.01) |
| ***H01P 1/203*** | (2006.01) |

(52) U.S. Cl.

CPC ..... *H01Q 3/32* (2013.01); *H01P 1/18* (2013.01); *H01P 1/184* (2013.01); *H01P 1/20* (2013.01); *H01P 1/2039* (2013.01)

(58) Field of Classification Search

CPC .. H01P 1/18; H01P 1/182; H01P 1/184; H01P 1/20; H01P 1/202; H01P 1/205; H01P 1/2039; H01Q 3/32; H01Q 1/50

See application file for complete search history.

(56) References Cited

U.S. PATENT DOCUMENTS 4,617,539 A * 10/1986 O'Shea ..... H01P 1/185 333/156
4,959,658 A * 9/1990 Collins ..... H01P 1/173 343/778
5,023,866 A 6/1991 De Muro (Continued)

FOREIGN PATENT DOCUMENTS

CN 201430200 Y 3/2010
CN 102544733 A 7/2012

(Continued)

*Primary Examiner* — Tho G Phan

(74) *Attorney, Agent, or Firm* — Leydig, Voit & Mayer, Ltd.

(57) ABSTRACT

A phase shifter may include a cavity body, and a fixed circuit board and a phase shift unit that are located inside the cavity body, and the phase shift unit being capable of moving relative to the fixed circuit board. A power division circuit is disposed on the fixed circuit board. The power division circuit includes an input end, a main feeder, a node, at least two output ends, a filtering stub, and at least two output circuits. The main feeder is electrically connected between the input end and the node. The filtering stub is electrically connected to the main feeder, and the filtering stub is in an open-circuit state. The at least two output circuits are respectively electrically connected between the node and the at least two output ends. The phase shift unit is disposed in correspondence with the at least two output circuits.

20 Claims, 3 Drawing Sheets

(56) References Cited

U.S. PATENT DOCUMENTS

| | | | | |
|---|---|---|---|---|
| 6,025,803 | A * | 2/2000 | Bergen | H01Q 1/246 343/700 MS |
| 6,677,899 | B1 * | 1/2004 | Lee | H01Q 3/36 342/372 |
| 9,444,151 | B2 * | 9/2016 | Kurk | H01Q 21/30 |
| 10,062,940 | B2 * | 8/2018 | Liu | H01P 1/18 |
| 10,199,702 | B2 * | 2/2019 | Liao | H01Q 3/32 |
| 2015/0116180 | A1 | 4/2015 | Wu | |
| 2017/0069941 | A1 | 3/2017 | Liu et al. | |

FOREIGN PATENT DOCUMENTS

| | | | |
|---|---|---|---|
| CN | 103050764 | A | 4/2013 |
| CN | 103107387 | A | 5/2013 |
| CN | 104051821 | A | 9/2014 |
| CN | 104103875 | A | 10/2014 |
| CN | 203967218 | U | 11/2014 |

* cited by examiner

PHASE SHIFTER AND ANTENNA

CROSS-REFERENCE TO RELATED APPLICATIONS

This application is a continuation of International Application No. PCT/CN2015/082051, filed on Jun. 23, 2015, which is hereby incorporated by reference in the entirety.

TECHNICAL FIELD

The present application relates to the antenna field, and in particular, to a phase shifter applicable to an antenna and having a filtering element, and an antenna.

BACKGROUND

In a mobile communications system, due to requirements of network coverage or network optimization, a beam direction of a base station antenna on a pitch plane needs to be adjusted. For example, a beam on the pitch plane may be adjusted by using an adjustable phase shifter. A working principle of the adjustable phase shifter is to adjust a downtilt of the beam of the antenna by changing phase distribution of each antenna element in the array antenna. In this way, not only a main beam direction can be continuously adjusted, but also it can be ensured that a beam on a horizontal plane is not deformed. There are mainly two types of adjustable phase shifters: a dielectric phase shifter and a physical phase shifter. The dielectric phase shifter implements a phase shift by changing a waveguide wavelength, and the physical phase shifter implements a phase shift by changing a length of a transmission path of an electromagnetic wave. However, as a quantity of remote electrical tilt antennas increases, a filter needs to be added at a front end of a phase shifter, to ensure that frequency bands do not interfere with each other, thereby increasing inter-frequency isolation. Currently, most remote electrical tilt antennas use a separate filter and a separate phase shifter, to implement an inter-frequency isolation function and a downtilt adjustment function. A separate filter and a separate phase shifter increase costs of a remote electrical tilt antenna and difficulty of design, which results in a complex connection of an entire main feeder network. As a result, a quantity of screws or welding points is increased, and magnitude and stability of PIM are reduced.

SUMMARY

Embodiments of the present application provide a phase shifter and an antenna. The phase shifter includes a filtering unit. This helps to reduce costs of an antenna, simplify a connection of a main feeder network, and reduce a quantity of screws or welding points, thereby improving magnitude and stability of PIM.

According to an aspect, the present application provides a phase shifter, including: a cavity body, and a fixed circuit board and a phase shift unit that are located inside the cavity body, and the phase shift unit being capable of moving relative to the fixed circuit board, where a power division circuit is disposed on the fixed circuit board, and the power division circuit includes an input end, a main feeder, a node, at least two output ends, a filtering stub, and at least two output circuits; the main feeder is electrically connected between the input end and the node; the filtering stub is electrically connected to the main feeder, and the filtering stub is in an open-circuit state; the at least two output circuits are respectively electrically connected between the node and the at least two output ends; the phase shift unit is disposed in correspondence with the at least two output circuits, and the phase shift unit is configured to change a phase value that is from the node to the at least two output ends.

According to another aspect, the present application further provides an antenna. The antenna includes the phase shifter according to any one of the first aspect and antenna elements, and the output ends of the phase shifter are respectively connected to the antenna elements by using an output cable.

Compared with the prior art, the phase shifter provided in the present application includes a filtering stub and a phase shift unit. The filtering stub is electrically connected to a main feeder, and the filtering stub is in an open-circuit state. In the present application, the filtering stub and the phase shift unit are integrated into the phase shifter, so that costs of an antenna are reduced. Because a separate phase shifter and a separate filter do not need to be assembled in a main feeder network of the antenna, a connection manner of the main feeder network is simplified, thereby reducing a quantity of screws or welding points and improving magnitude and stability of PIM.

BRIEF DESCRIPTION OF DRAWINGS

To describe the technical solutions in the embodiments of the present application more clearly, the following briefly describes the accompanying drawings required for describing the embodiments. Apparently, the accompanying drawings in the following description show merely some embodiments of the present application, and a person of ordinary skill in the art may still derive other drawings from these accompanying drawings without creative efforts.

DESCRIPTION OF EMBODIMENTS

The following clearly describes the technical solutions in the embodiments of the present application with reference to the accompanying drawings in the embodiments of the present application. Apparently, the described embodiments are merely some but not all of the embodiments of the present application. All other embodiments obtained by a person of ordinary skill in the art based on the embodiments of the present application without creative efforts shall fall within the protection scope of the present application.

Figure 1:
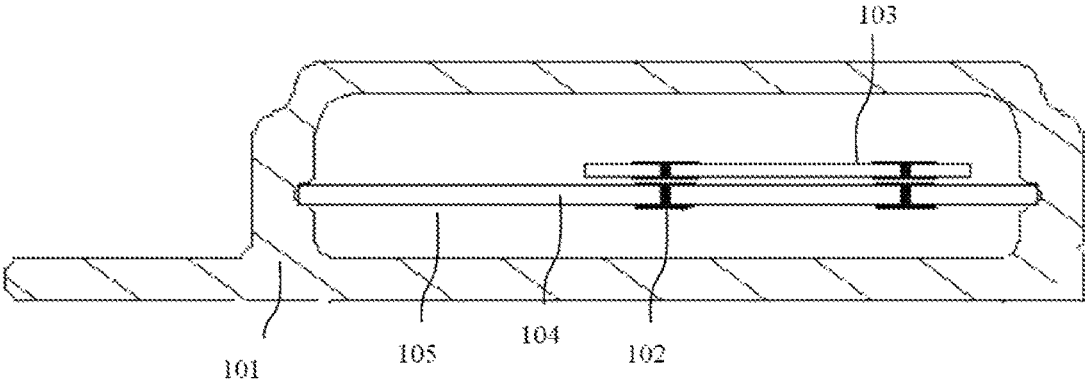
FIG. 1 is a schematic cross-sectional view of a phase shifter according to a first implementation of the present application.
Figure 3:
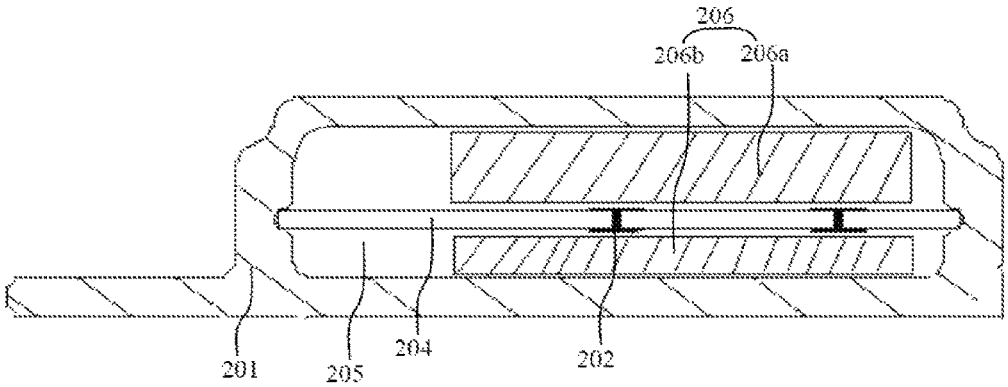
FIG. 3 is a schematic cross-sectional view of a phase shifter according to a second implementation of the present application.
Figure 5:
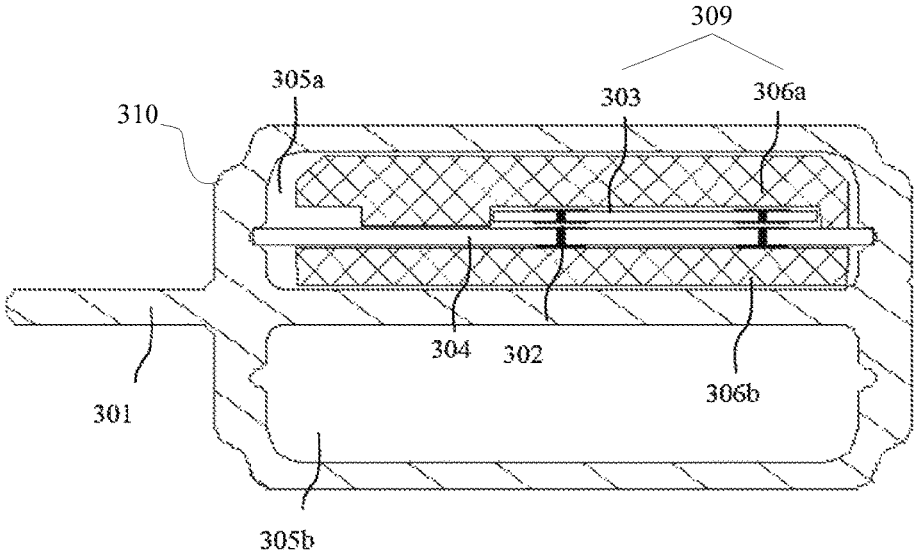
FIG. 5 is a schematic cross-sectional view of a phase shifter according to a third implementation of the present application.

Referring to FIG. 1, FIG. 3, and FIG. 5, FIG. 1, FIG. 3, and FIG. 5 describe phase shifters according to three implementations of the present application. The phase shifters provided in the present application include cavity bodies 101, 201, and 301, respectively, and fixed circuit boards 104, 204, and 304, respectively, and phase shift units, respectively, where the fixed circuit boards 104, 204, and 304, and the phase shift units are located inside the cavity bodies 101, 201, and 301, respectively. The phase shift units are capable of moving relative to the fixed circuit boards 104, 204, and 304. Power division circuits 102, 202, and 302 are disposed on the fixed circuit boards 104, 204, and 304, respectively. For example, the phase shift unit may include one or more electronic components to perform phase shift function.

Figure 2:
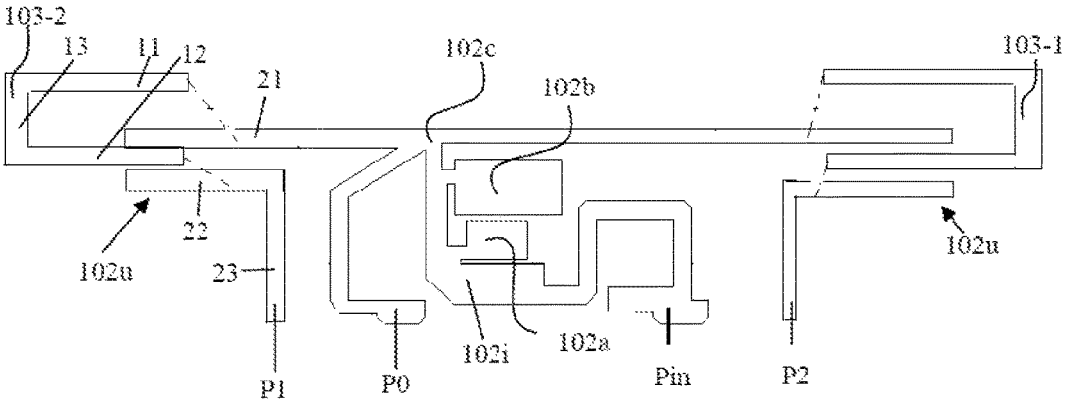
FIG. 2 is a schematic diagram of a power division circuit on a fixed circuit board in the phase shifter shown in FIG. 1.
Figure 4:
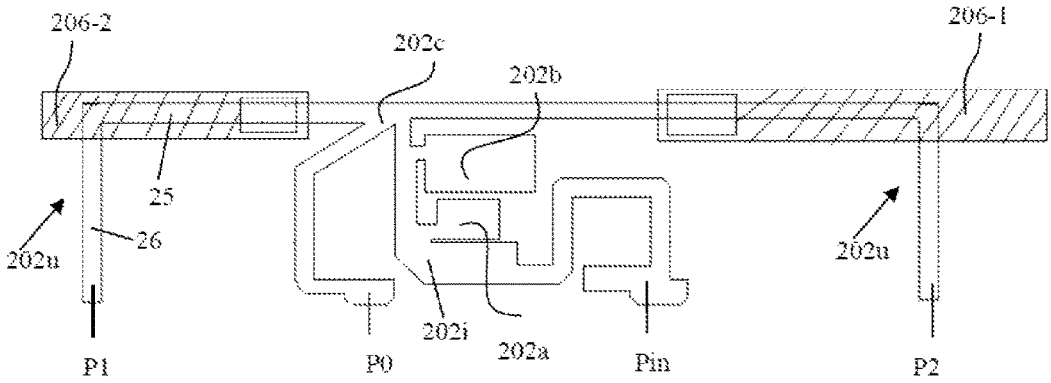
FIG. 4 is a schematic diagram of a power division circuit on a fixed circuit board in the phase shifter shown in FIG. 3, where a positional relationship between a dielectric and the fixed circuit board is included.

As shown in FIG. 2 and FIG. 4, only the power division circuits 102 and 202 in the first two implementations are described in detail below. Either of the first two implementations may be used in a third implementation. The power division circuit 102 (302) includes an input end pin, a main feeder 102*i*, a node 102*c*, at least two output ends P0, P1, and P2, filtering stubs 102*a* and 102*b*, and at least two output circuits 102*u*. The power division circuit 202 (302) includes an input end Pin, a main feeder 202*i*, a node 202*c*, at least two output ends P0, P1, and P2, filtering stubs 202*a* and 202*b*, and at least two output circuits 202*u*. The main feeder 102*i* is electrically connected between the input end Pin and the node 102*c*, and the main feeder 202*i* is electrically connected between the input end Pin and the node 202*c*. The filtering stubs 102*a* and 102*b* are electrically connected to the main feeder 102*i*, and the filtering stubs 202*a* and 202*b* are electrically connected to the main feeder 202*i*. The filtering stubs 102*a*, 102*b*, 202*a*, and 202*b* are in an open-circuit state. The at least two output circuits 102*u* are electrically connected between the node 102*c* and the at least two output ends P0, P1, and P2, and the at least two output circuits 202*u* are electrically connected between the node 202*c* and the at least two output ends P0, P1, and P2. The phase shift unit 103 is disposed together with the at least two output circuits 102*u*, and the phase shift unit 206 is disposed together with the at least two output circuits 202*u*. The phase shift unit 103 is configured to change a phase value that is from the node 102*c* to the at least two output ends P0, P1, and P2, and the phase shift unit 206 is configured to change a phase value that is from the node 202*c* to the at least two output ends P0, P1, and P2.

That the filtering stubs 102*a*, 102*b*, 202*a*, and 202*b* are in an open-circuit state means that one end of the filtering stub 102*a* and one end of the filtering stub 102*b* (which are referred to as connected ends below) are connected to the main feeder 102*i*, and one end of the filtering stub 202*a* and one end of the filtering stub 202*b* (which are referred to as connected ends below) are connected to the main feeder 202*i*. The other end of the filtering stub 102*a*, the other end of the filtering stub 102*b*, the other end of the filtering stub 202*a*, and the other end of the 202*b* (which are referred to as free ends below) are in an open-circuit state (that is, connected to no circuit). Specifically, lengths of the filtering stubs 102*a*, 102*b*, 202*a*, and 202*b* range between 1/16 and 3/4 of a wavelength. The wavelength is a wavelength of an electromagnetic wave filtered out by the filtering stubs 102*a*, 102*b*, 202*a*, and 202*b*. The lengths of the filtering stubs 102*a*, 102*b*, 202*a*, and 202*b* are lengths of paths between the free ends and the connected ends of the filtering stubs 102*a*, 102*b*, 202*a*, and 202*b*. There are two filtering stubs 102*a* and 102*b*, and there are two filtering stubs 202*a* and 202*b*. A distance between the two filtering stubs 102*a* and 102*b* and a distance between the two filtering stubs 202*a* and 202*b* range between 1/16 and 3/4 of a wavelength. The wavelength is a wavelength of an electromagnetic wave filtered out by the filtering stubs 102*a*, 102*b*, 202*a*, and 202*b*.

The phase shift unit may be a movable circuit board in the first implementation shown in FIG. 1 and FIG. 2. Alternatively, the phase shift unit may be a dielectric in the second implementation shown in FIG. 3 and FIG. 4. Alternatively, the phase shift unit may be a combination of a movable circuit board and a dielectric layer in the third implementation shown in FIG. 5. The dielectric may be referred as the dielectric layer as well.

Referring to FIG. 1 and FIG. 2, in the first implementation, the phase shift unit includes a movable circuit board 103. Phase shift circuits 103-1 and 103-2 are disposed on the movable circuit board 103. The movable circuit board 103 is disposed in parallel on one side of the fixed circuit board 104. The movable circuit board 103 is capable of sliding relative to the fixed circuit board 104. The phase shift circuits 103-1 and 103-2 are electrically coupled to one of the at least two output circuits 102*u*, to implement a phase shift function. When the phase shift circuits 103-1 and 103-2 move relative to the output circuits 102*u* on the fixed circuit board 104, the phase shift circuits 103-1 and 103-2 and the output circuits 102*u* are electrically coupled, to transmit a high-frequency current.

Specifically, the phase shift circuits 103-1 and 103-2 each include a metal microstrip extending in a U shape. The phase shift circuits 103-1 and 103-2 each include a first arm 11 and a second arm 12 that are separated and disposed opposite to each other, and a connection arm 13 connected between the first arm 11 and the second arm 12. One of the output circuits 102*u* includes a first transmission section 21, a second transmission section 22, and an output section 23. The first transmission section 21 is electrically connected to the node 102*c*. The first transmission section 21 and the second transmission section 22 are separated and disposed opposite to each other. The output section 23 is connected between the second transmission section 22 and the output end P1. The first arm 11 is disposed opposite to the first transmission section 21, and the second arm 12 is disposed opposite to the second transmission section 22. The phase shift circuits 103-1 and 103-2 are of a metal microstrip structure, so that the phase shift circuits 103-1 and 103-2 are not in direct contact with the power division circuit 102 and maintain a gap, to form an electric coupling structure.

As shown in FIG. 2, multiple phase shift circuits 103-1 and 103-2 are disposed on the movable circuit board 103. The power division circuit 102 on the fixed circuit board 104 includes multiple output circuits 102*u* coupled to the phase shift circuits 103-1 and 103-2.

Referring to FIG. 3 and FIG. 4, in the second implementation, the phase shift unit includes a dielectric 206. The dielectric 206 is disposed on one side or either side of the fixed circuit board 204. The dielectric 206 is capable of sliding relative to the fixed circuit board 204, to implement a phase shift function. The dielectric 206 may be in contact with the fixed circuit board 204. Alternatively, a gap may be provided between the dielectric 206 and the fixed circuit board 204. In this implementation, the dielectric 206 is located on either side of the fixed circuit board 204, namely a first dielectric 206*a* and a second dielectric 206*b*.

Specifically, one of the output circuits 202*u* includes a phase shift section 25 and a third transmission section 26.

The phase shift section 25 is electrically connected between the node 202*c* and the third transmission section 26. The third transmission section 26 is electrically connected between the phase shift section 25 and the output end P1. The dielectric 206 is disposed together with the phase shift section 25, where the dielectric 206 and the phase shift section 25 cooperate with each other.

As shown in FIG. 4, the phase shift unit includes multiple dielectric layers 206-*a* and 206-*b*. The power division circuit 202 on the fixed circuit board 204 includes multiple output circuits 202*u* matching the phase shift unit.

Referring to FIG. 5, the phase shift unit 309 includes a movable circuit board 303 and dielectric layers 306*a* and 306*b*. The movable circuit board 303 is located between the dielectric layer 306*a* and the fixed circuit board 304, and the movable circuit board 303 is capable of moving relative to the fixed circuit board 304. A phase shift circuit is disposed on the movable circuit board 303. The phase shift circuit is electrically coupled to one of at least two output circuits of the power division circuit on the fixed circuit board 304, to implement a phase shift function. The dielectric layers 306*a* and 306*b* are capable of sliding relative to the fixed circuit board 304, to implement a phase shift function.

Figure 6:
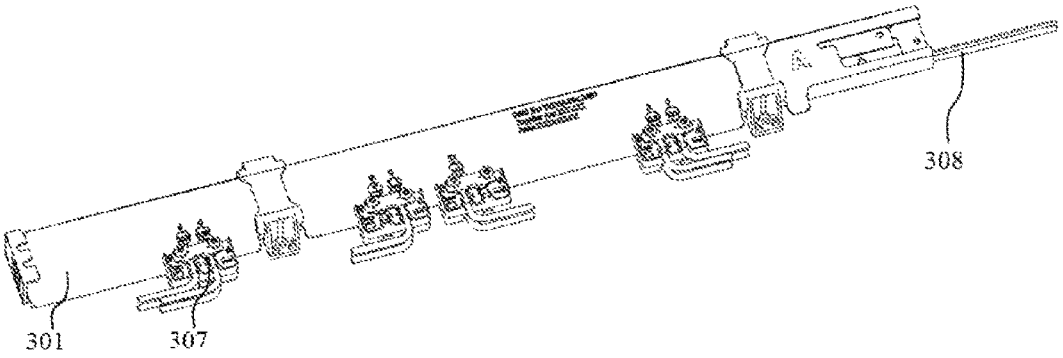
FIG. 6 is an overall schematic perspective view of a phase shifter according to an implementation of the present application.

Specifically, the cavity bodies 101, 201, and 301 are extruded cavity bodies, inside which accommodating space 105, 205, and 305 are formed. The third implementation is used as an example to describe the cavity bodies 101, 201, and 301 in detail. Referring to FIG. 6, FIG. 6 is an overall view of an appearance of a phase shifter according to an implementation. A housing 310 of the cavity body 301 is grounded. As shown in FIG. 5, a cross-section of the cavity body 301 includes a "日" shape structure. A middle part of the cavity body 301 of the "日" shape structure is used as shared ground, so that a thickness of the phase shifter is effectively reduced. The housing 310 may include a first cavity 305*a* and a second cavity 305*b* inside the housing. There are two fixed circuit boards 304. The fixed circuit boards 304 are respectively fixed in the first cavity 305*a* and the second cavity 305*b*. The power division circuits 302 on the fixed circuit boards 304 respectively form first and second suspended microstrip structures inside the first cavity 305*a* and the second cavity 305*b*. The suspended microstrip may also be referred to as the suspended substrate stripline. In the suspended microstrip structure, the power division circuits 302 and the fixed circuit boards 304 are hanging between the upper surface and the lower surface of the housing without touching either the upper surface or the lower surface. For brevity of description, only the fixed circuit board 304 and the phase shift unit in the first cavity 305*a* are shown in FIG. 5. In an actual product, distribution of the fixed circuit board 304 and the phase shift unit in the second cavity 305*b* may be the same as that in the first cavity 305*a*.

Specifically, locating slots are disposed on an inner wall of the cavity body 301 to locate the fixed circuit board 304. A pair of edges of the fixed circuit board 304 is engaged with the locating slots. A pulling rod 308 drives the phase shift unit to move. The pulling rod 308 may be driven by a motor or another drive apparatus, to drive the phase shift unit to move. Multiple connection boxes 307 are connected to an outer part of the cavity body 301. The phase shifter shown in FIG. 6 includes four connection boxes 307.

The fixed circuit boards 104, 204, and 304 each include a top surface and a bottom surface. A via hole is provided on each of the fixed circuit boards 104, 204, and 304. The via hole is connected between the top surface and the bottom surface. The power division circuits 102, 202, and 302 are metal microstrip structures distributed on the top surfaces and the bottom surfaces. The power division circuit distributed on the top surface is electrically connected through the hole to the power division circuit distributed on the bottom surface.

Figure 7:
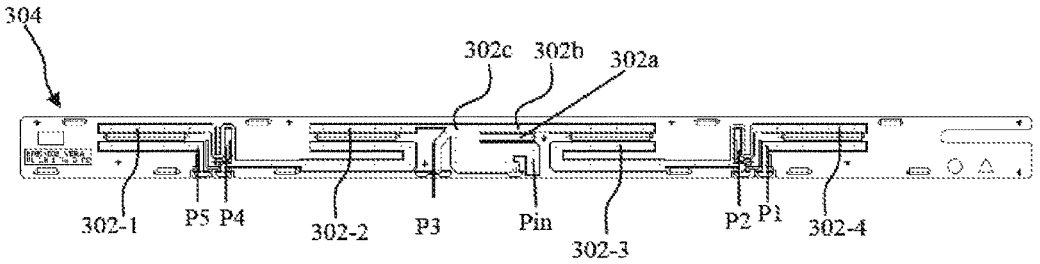
FIG. 7 is a schematic plan view of a fixed circuit board in a phase shifter according to an implementation of the present application.

FIG. 7 is an overall schematic view of a fixed circuit board 304 according to an implementation of the present application. The fixed circuit board 304 includes an input end Pin, five output ends P1, P2, P3, P4, and P5, a node 302*c*, filtering stubs 302*a* and 302*b*, and four coupling circuits 302-1, 302-2, 302-3, and 302-4. The four coupling circuits 302-1, 302-2, 302-3, and 302-4 are configured to match a phase shift unit, to implement a phase shift function.

Figure 8:
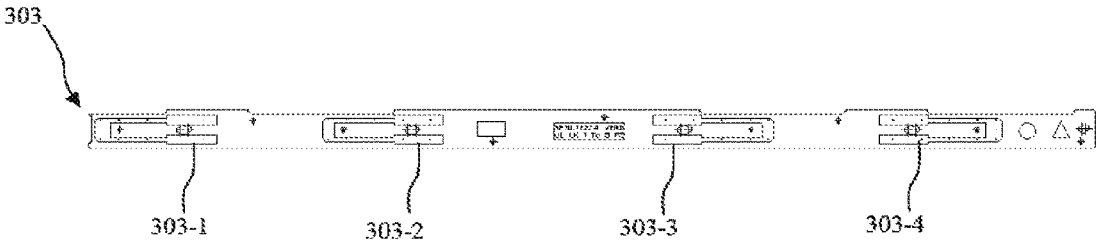
FIG. 8 is a schematic plan view of a movable circuit board in a phase shifter according to an implementation of the present application.

FIG. 8 is an overall schematic view of a movable circuit board 303 according to an implementation of the present application. The movable circuit board 303 includes four phase shift circuits 303-1, 303-2, 303-3, and 303-4. Specifically, the four phase shift circuits 303-1, 303-2, 303-3, and 303-4 are all U-shaped microstrips.

In an actual use process, the coupling circuit 302-1 is electrically coupled to the phase shift circuit 303-1, the coupling circuit 302-2 is electrically coupled to the phase shift circuit 303-2, the coupling circuit 302-3 is electrically coupled to the phase shift circuit 303-3, and the coupling circuit 302-4 is electrically coupled to the phase shift circuit 303-4. By means of such a design, it can be ensured that a signal that is input from the input end Pin can be transmitted to the output ends P1, P2, P3, P4, and P5. As shown in FIG. 7, a signal is input from the input end Pin, and after an interference frequency band signal is filtered out by using the filtering stubs 302*a* and 302*b*, the signal reaches the node 302*c*. A current passing through the node 302*c* undergoes coupling of the coupling circuit 302-1 and the phase shift circuit 303-1, coupling of the coupling circuit 302-2 and the phase shift circuit 303-2, coupling of the coupling circuit 302-3 and the phase shift circuit 303-3, and coupling of the coupling circuit 302-4 and the phase shift circuit 303-4, thereby transmitting energy.

For power of a signal, power allocation may be implemented by adjusting power division circuits between the coupling circuits.

For a phase of a signal, the output end P5 is obtained by connecting in series a coupling circuit to the output end P4. After a pulling rod drives the movable circuit board 303 to move for a distance, a phase difference generated at the output end P5 is twice greater than that generated at the output end P4, so that a phase that is output at the output end P5 is 2Φ, and a phase that is output at the output end P4 end is Φ. Likewise, a phase that is output at the output end P1 is twice greater than a phase that is output at the output end P2. To make phase differences that are output at the output ends P5\P4\P3\P2\P1 equal or approximately equal, the coupling circuits 302-1 and 302-2 are disposed opposite to the coupling circuits 302-3 and 302-4, respectively, that is, the circuits are distributed symmetrically on two sides of the input end Pin. In this way, phase differences between phases that are output at the output ends P5\P4\P\P2\P1 after the movable circuit board 303 is driven by the pulling rod to move for a distance and phases that exist before the movable circuit board 303 is moved are respectively 2Φ, 1Φ, 0Φ, −1Φ, and −2Φ.

The present application further provides an antenna. The antenna includes the phase shifter and antenna elements. The output ends of the phase shifter are respectively connected to the antenna elements by using an output cable. To further describe usage of the phase shifter of the present application, the output ends P5\P4\P3\P2\P1 are respectively electrically connected to the antenna elements of an array antenna. After a pulling rod drives a movable circuit board to move for a distance, a high-frequency current signal fed from the input end Pin can feed required signal current strengths and phases to the antenna elements by means of an operation of the phase shifter, thereby changing a direction of a radiation pattern of the array antenna.

In a first possible implementation, a length of the filtering stub ranges between 1/16 and 3/4 of a wavelength, and the wavelength is a wavelength of an electromagnetic wave filtered out by the filtering stub.

In a second possible implementation, there are two filtering stubs, a distance between the two filtering stubs ranges between 1/16 and 3/4 of a wavelength, and the wavelength is a wavelength of an electromagnetic wave filtered out by the filtering stubs.

With reference to the second possible implementation, in a third possible implementation, the phase shift unit includes a movable circuit board, a phase shift circuit is disposed on the movable circuit board, the movable circuit board is disposed in parallel on one side of the fixed circuit board, the movable circuit board is capable of sliding relative to the fixed circuit board, and the phase shift circuit is electrically coupled to one of the at least two output circuits, to implement a phase shift function.

With reference to the third possible implementation, in a fourth possible implementation, the phase shift circuit includes a metal microstrip extending in a U shape, the phase shift circuit includes a first arm and a second arm that are separated and disposed opposite to each other, and a connection arm connected between the first arm and the second arm, one of the output circuits includes a first transmission section, a second transmission section, and an output section, the first transmission section is electrically connected to the node, the first transmission section and the second transmission section are separated and disposed opposite to each other, the output section is connected between the second transmission section and one of the output ends, the first arm is disposed opposite to the first transmission section, and the second arm is disposed opposite to the second transmission section.

With reference to the fourth possible implementation, in a fifth possible implementation, multiple phase shift circuits are disposed on the movable circuit board, and the power division circuit on the fixed circuit board includes multiple output circuits coupled to the phase shift circuits.

With reference to the second possible implementation, in a sixth possible implementation, the phase shift unit includes a dielectric, the dielectric is disposed on one side or either side of the fixed circuit board, and the dielectric is capable of sliding relative to the fixed circuit board, to implement a phase shift function.

With reference to the sixth possible implementation, in a seventh possible implementation, one of the output circuits includes a phase shift section and a third transmission section, the phase shift section is electrically connected between the node and the third transmission section, the third transmission section is electrically connected between the phase shift section and one of the output ends, and the dielectric is disposed in correspondence with the phase shift section.

With reference to the seventh possible implementation, in an eighth possible implementation, the phase shift unit includes multiple dielectric layers, and the power division circuit on the fixed circuit board includes multiple output circuits matching the phase shift unit.

With reference to the second possible implementation, in a ninth possible implementation, the phase shift unit includes a movable circuit board and a dielectric layer, the movable circuit board is located between the dielectric and the fixed circuit board, the movable circuit board is capable of moving relative to the fixed circuit board, a phase shift circuit is disposed on the movable circuit board, the phase shift circuit is electrically coupled to one of the at least two output circuits, to implement a phase shift function, and the dielectric is capable of sliding relative to the fixed circuit board, to implement a phase shift function.

With reference to the second possible implementation, in a tenth possible implementation, a housing of the cavity body is grounded, a cross-section of the cavity body includes a "日" shape structure, a first cavity and a second cavity are formed inside the housing, there are two fixed circuit boards, the fixed circuit boards are respectively fixed in the first cavity and the second cavity, and the power division circuits on the fixed circuit boards respectively form suspended microstrip structures inside the first cavity and the second cavity.

With reference to the second possible implementation, in an eleventh possible implementation, the fixed circuit board includes a top surface and a bottom surface, a via hole is provided on the fixed circuit board, the via hole is connected between the top surface and the bottom surface, the power division circuit is a metal microstrip structure distributed on the top surface and the bottom surface, and the power division circuit distributed on the top surface is electrically connected through the hole to the power division circuit distributed on the bottom surface.

Compared with the prior art, the phase shifter provided in the present application includes a filtering stub and a phase shift unit. The filtering stub is electrically connected to a main feeder, and the filtering stub is in an open-circuit state. In the present application, the filtering stub and the phase shift unit are integrated into the phase shifter, so that costs of an antenna are reduced. Because a separate phase shifter and a separate filter do not need to be assembled in a main feeder network of the antenna, a connection manner of the main feeder network is simplified, thereby reducing a quantity of screws or welding points and improving magnitude and stability of PIM.

The foregoing describes in detail the phase shifter and the antenna provided in the embodiments of the present application. In this specification, specific examples are used to describe the principle and implementations of the present application, and the description of the embodiments is only intended to help understand the method and core idea of the present application. In addition, a person of ordinary skill in the art may, based on the idea of the present application, make modifications with respect to the specific implementations and the application scope. Therefore, the content of this specification shall not be construed as a limitation to the present application.

What is claimed is:

1. A phase shifter, comprising:

a cavity body, and a fixed circuit board and a phase shift unit that are located inside the cavity body, and the phase shift unit being capable of moving relative to the fixed circuit board, wherein a power division circuit is disposed on the fixed circuit board, and the power division circuit comprises an input end, a main feeder, a node, at least two output ends, at least one filtering stub, and at least two output circuits;

wherein the main feeder is electrically connected between the input end and the node; the at least one filtering stub is electrically connected to the main feeder, and the at least one filtering stub is in an open-circuit state; the at least two output circuits are respectively electrically connected between the node and the at least two output ends; and wherein the phase shift unit is coupled with one of the at least two output circuits, and the phase shift unit is configured to change a phase value that is from the node to the at least two output ends.

2. The phase shifter according to claim 1, wherein a length of the at least one filtering stub ranges between 1/16 and 3/4 of a wavelength, and the wavelength is a wavelength of an electromagnetic wave filtered out by the at least one filtering stub.

3. The phase shifter according to claim 1, wherein the at least one filtering stub comprises two filtering stubs, a distance between the two filtering stubs ranges between 1/16 and 3/4 of a wavelength, and the wavelength is a wavelength of an electromagnetic wave filtered out by the two filtering stubs.

4. The phase shifter according to claim 3, wherein the phase shift unit comprises a movable circuit board, a phase shift circuit is disposed on the movable circuit board, the movable circuit board is disposed in parallel on one side of the fixed circuit board, the movable circuit board is capable of sliding relative to the fixed circuit board, and the phase shift circuit is electrically coupled to one of the at least two output circuits, to implement a phase shift function.

5. The phase shifter according to claim 4, wherein the phase shift circuit comprises a metal microstrip extending in a U shape, the phase shift circuit comprises a first arm and a second arm that are separated and disposed opposite to each other, and a connection arm connected between the first arm and the second arm, one of the output circuits comprises a first transmission section, a second transmission section, and an output section, the first transmission section is electrically connected to the node, the first transmission section and the second transmission section are separated and disposed opposite to each other, the output section is connected between the second transmission section and one of the output ends, the first arm is disposed opposite to the first transmission section, and the second arm is disposed opposite to the second transmission section.

6. The phase shifter according to claim 5, wherein multiple phase shift circuits are disposed on the movable circuit board, and the power division circuit on the fixed circuit board comprises multiple output circuits coupled to the phase shift circuits.

7. The phase shifter according to claim 3, wherein the phase shift unit comprises a dielectric layer, the dielectric layer is disposed on one side or either side of the fixed circuit board, and the dielectric layer is capable of sliding relative to the fixed circuit board, to implement a phase shift function.

8. The phase shifter according to claim 7, wherein one of the output circuits comprises a phase shift section and a third transmission section, the phase shift section is electrically connected between the node and the third transmission section, the third transmission section is electrically connected between the phase shift section and one of the output ends, and the dielectric layer is disposed adjacent with the phase shift section.

9. The phase shifter according to claim 8, wherein the phase shift unit comprises multiple dielectric layers, and the power division circuit on the fixed circuit board comprises multiple output circuits matching the phase shift unit.

10. The phase shifter according to claim 3, wherein the phase shift unit comprises a movable circuit board and a dielectric layer, the movable circuit board is located between the dielectric layer and the fixed circuit board, the movable circuit board is capable of moving relative to the fixed circuit board, a phase shift circuit is disposed on the movable circuit board, the phase shift circuit is electrically coupled to one of the at least two output circuits, to implement a phase shift function, and the dielectric layer is capable of sliding relative to the fixed circuit board, to implement a phase shift function.

11. The phase shifter according to claim 3, wherein a housing of the cavity body is grounded, a cross-section of the cavity body includes a "日" shape structure, the housing comprises a first cavity and a second cavity inside the housing, a first fixed circuit board is fixed in the first cavity, a second fixed circuit board is fixed in the second cavity, and the power division circuit on the first fixed circuit board form a first suspended microstrip structure inside the first cavity, a second power division circuit on the second fixed circuit board form a second suspended microstrip structure inside the second cavity.

12. The phase shifter according to claim 3, wherein the fixed circuit board comprises a top surface and a bottom surface, a via hole is provided on the fixed circuit board, the via hole is connected between the top surface and the bottom surface, the power division circuit is a metal microstrip structure distributed on the top surface and the bottom surface, and the power division circuit distributed on the top surface is electrically connected through the hole to the power division circuit distributed on the bottom surface.

13. An antenna, the antenna comprises a phase shifter, wherein the phase shifter comprises:

a cavity body, and a fixed circuit board and a phase shift unit that are located inside the cavity body, and the phase shift unit being capable of moving relative to the fixed circuit board, wherein a power division circuit is disposed on the fixed circuit board, and the power division circuit comprises an input end, a main feeder, a node, at least two output ends, at least one filtering stub, and at least two output circuits;

wherein the main feeder is electrically connected between the input end and the node; the at least one filtering stub is electrically connected to the main feeder, and the at least one filtering stub is in an open-circuit state; the at least two output circuits are respectively electrically connected between the node and the at least two output ends;

wherein the phase shift unit is coupled with one of the at least two output circuits, and the phase shift unit is configured to change a phase value that is from the node to the at least two output ends; and wherein the output ends of the phase shifter are respectively connected to the antenna elements by using an output cable.

14. The antenna according to claim 13, wherein a length of the at least one filtering stub ranges between 1/16 and 3/4 of a wavelength, and the wavelength is a wavelength of an electromagnetic wave filtered out by the at least one filtering stub.

15. The antenna according to claim 13, wherein the at least one filtering stub comprises two filtering stubs, a distance between the two filtering stubs ranges between 1/16 and ¾ of a wavelength, and the wavelength is a wavelength of an electromagnetic wave filtered out by the two filtering stubs.

16. The antenna according to claim 15, wherein the phase shift unit comprises a movable circuit board, a phase shift circuit is disposed on the movable circuit board, the movable circuit board is disposed in parallel on one side of the fixed circuit board, the movable circuit board is capable of sliding relative to the fixed circuit board, and the phase shift circuit is electrically coupled to one of the at least two output circuits, to implement a phase shift function.

17. The antenna according to claim 16, wherein the phase shift circuit comprises a metal microstrip extending in a U shape, the phase shift circuit comprises a first arm and a second arm that are separated and disposed opposite to each other, and a connection arm connected between the first arm and the second arm, one of the output circuits comprises a first transmission section, a second transmission section, and an output section, the first transmission section is electrically connected to the node, the first transmission section and the second transmission section are separated and disposed opposite to each other, the output section is connected between the second transmission section and one of the output ends, the first arm is disposed opposite to the first transmission section, and the second arm is disposed opposite to the second transmission section.

18. The antenna according to claim 17, wherein multiple phase shift circuits are disposed on the movable circuit board, and the power division circuit on the fixed circuit board comprises multiple output circuits coupled to the phase shift circuits.

19. The antenna according to claim 15, wherein the phase shift unit comprises a dielectric layer, the dielectric layer is disposed on one side or either side of the fixed circuit board, and the dielectric layer is capable of sliding relative to the fixed circuit board, to implement a phase shift function.

20. The antenna according to claim 19, wherein one of the output circuits comprises a phase shift section and a third transmission section, the phase shift section is electrically connected between the node and the third transmission section, the third transmission section is electrically connected between the phase shift section and one of the output ends, and the dielectric layer is disposed adjacent with the phase shift section.

* * * * *